US008272777B2

(12) United States Patent
Kohrs et al.

(10) Patent No.: US 8,272,777 B2
(45) Date of Patent: Sep. 25, 2012

(54) METHOD FOR MIXING AN EXHAUST GAS FLOW

(75) Inventors: Stefan Kohrs, Neustadt/Weinstrasse (DE); Manfred Doll, Neustadt/Lachen (DE); Balthasar Hipp, Rheinstetten (DE); Günter Palmer, Neustadt (DE); Joachim Gehrlein, Rheinzabern (DE); Markus Jost, Mannheim (DE); Andreas Lang, Hassloch (DE)

(73) Assignee: Heinrich Gillet GmbH (Tenneco), Edenkoben (DE)

( * ) Notice: Subject to any disclaimer, the term of this patent is extended or adjusted under 35 U.S.C. 154(b) by 572 days.

(21) Appl. No.: 12/386,627

(22) Filed: Apr. 21, 2009

(65) Prior Publication Data

US 2009/0262599 A1 Oct. 22, 2009

(30) Foreign Application Priority Data

Apr. 21, 2008 (DE) ..... 10 2008 020 008

(51) Int. Cl.
*B01F 5/06* (2006.01)

(52) U.S. Cl. ..... 366/337

(58) Field of Classification Search ..... 366/337
See application file for complete search history.

(56) References Cited

U.S. PATENT DOCUMENTS 6,086,241 A * 7/2000 Herr et al. ..... 366/181.5
RE36,969 E * 11/2000 Streiff et al. ..... 366/173.1
2007/0204751 A1 9/2007 Wirth et al.
2008/0066448 A1 3/2008 Halbei et al.
2008/0308955 A1 12/2008 Beckmann et al.

FOREIGN PATENT DOCUMENTS

DE 202006017848 U1 3/2007
DE 102005052064 A1 5/2007
DE 102005059971 A1 6/2007
DE 102006024778 B3 7/2007
DE 102006043225 A1 3/2008

* cited by examiner

*Primary Examiner* — Yogendra Gupta
*Assistant Examiner* — Alison Hindenlang
(74) *Attorney, Agent, or Firm* — Hudak, Shunk & Farine Co. LPA

(57) ABSTRACT

The invention relates to a method for mixing an exhaust gas flow with a fluid in an exhaust gas pipe 40 of an exhaust gas system 4, in which the fluid is injected by means of an injection device 5 into the exhaust gas pipe 40. The exhaust gas flow is guided in the exhaust gas pipe 40 in the area of the injection device 5 in a direction of flow S parallel to the exhaust gas pipe 40. The fluid is injected directly onto a deflection element 6 which is arranged in the exhaust gas pipe 40 in a central direction of injection E which deviates from the direction of flow S by an angle se, wherein by means of at least one sheet metal part 60 which is provided on the deflection element 6 and which is raised at least partially at an angle sv with reference to the direction of flow S, the exhaust gas flow is diverted with reference to the direction of flow S from its direction of flow S into a central direction of distribution V. Before and after it impacts the deflection element 6, the fluid is carried along at least partially by the diverted part of the exhaust gas flow into the direction of distribution V and is diverted into the direction of distribution V by the raised sheet metal part 60.

27 Claims, 4 Drawing Sheets

Fig. 7
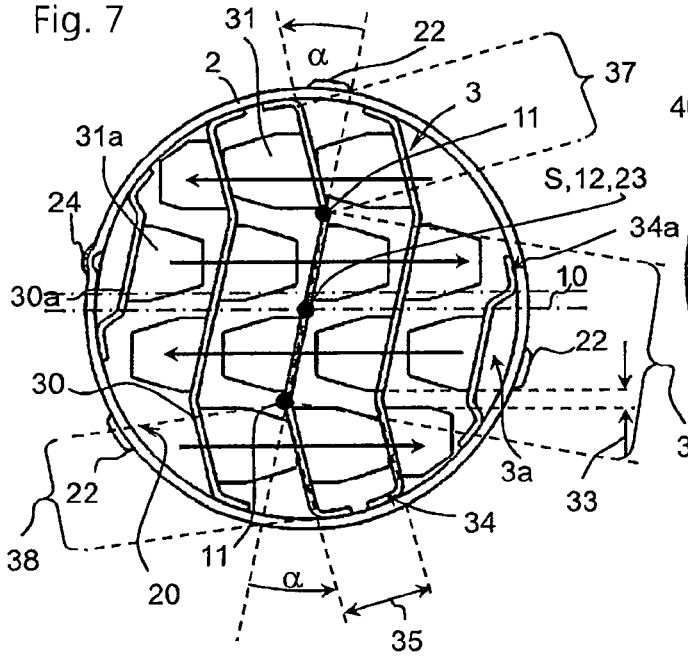
Fig. 6
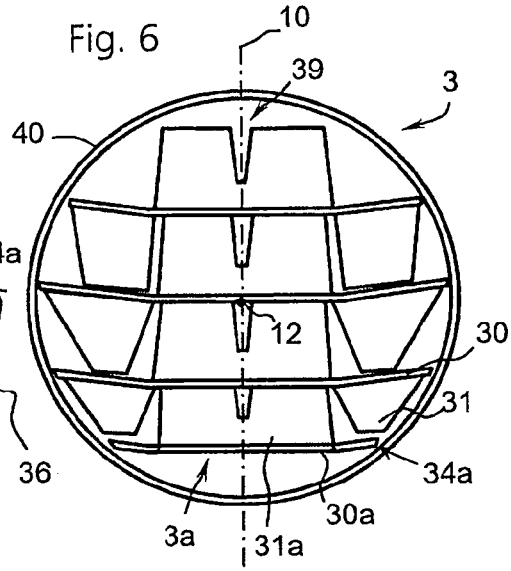
Fig. 8
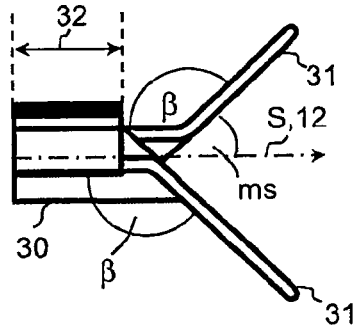
Fig. 9
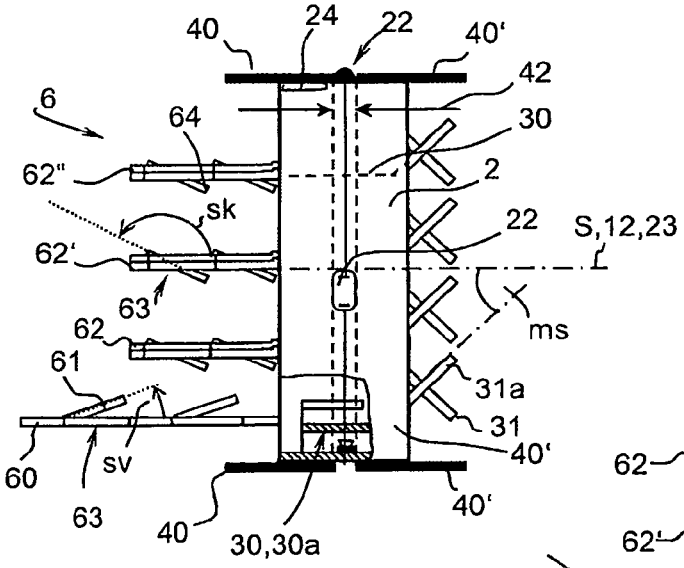
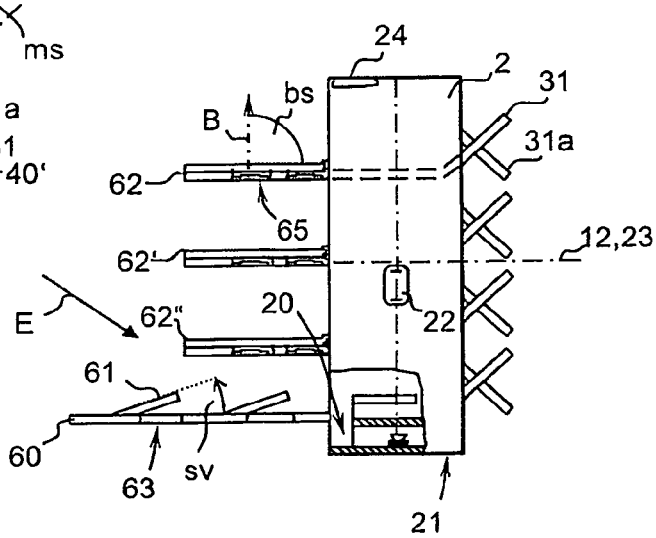
Fig. 9a

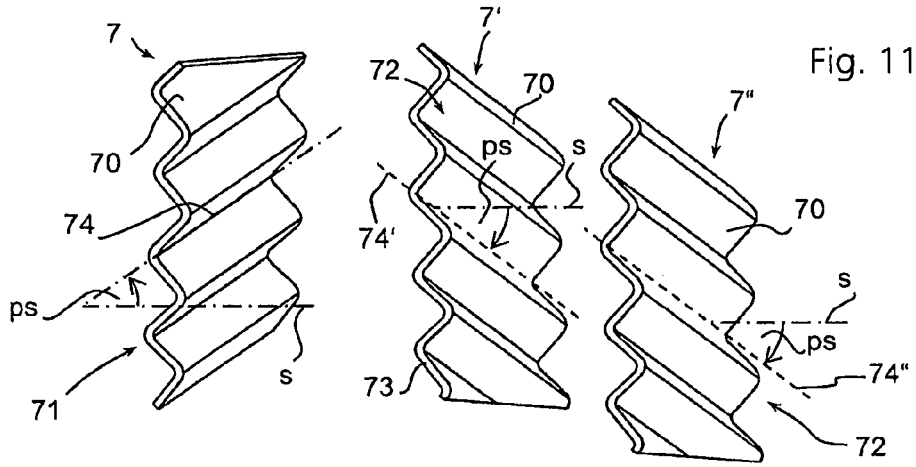
Fig. 11
Fig. 12
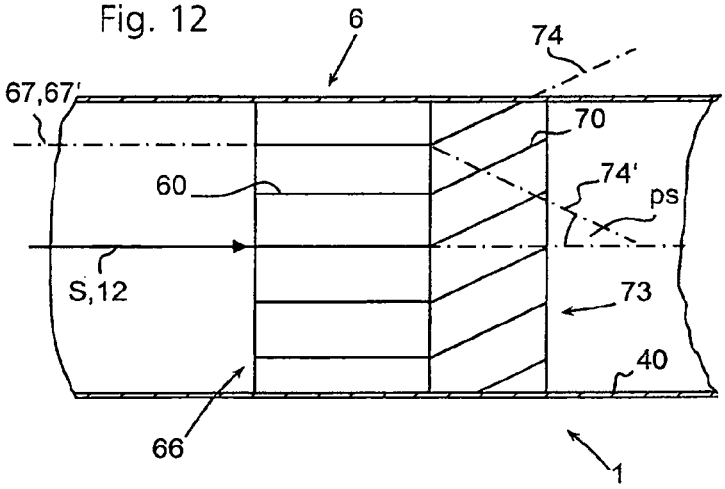
Fig. 10
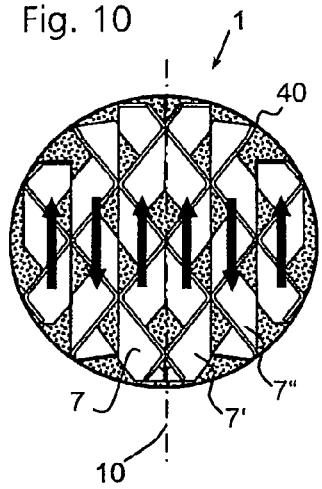
Fig. 13
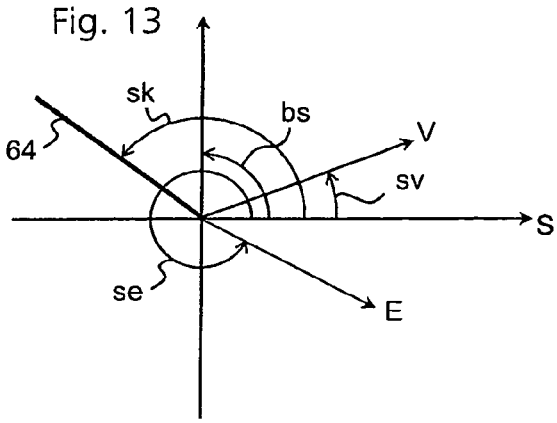
Fig. 14
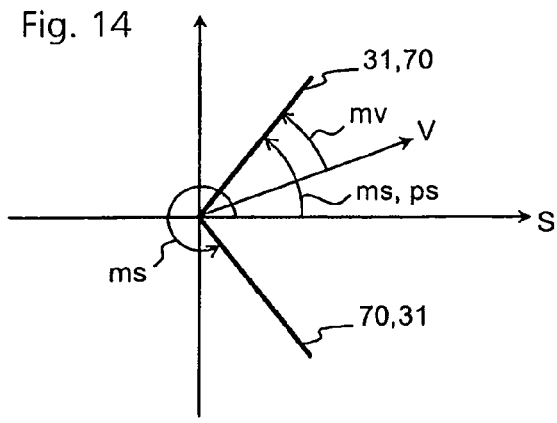

METHOD FOR MIXING AN EXHAUST GAS FLOW

BACKGROUND OF THE INVENTION

1. Field of the Invention

The invention relates to a method to use a mixer and to a mixer itself.

2. State of the Art

Several single-stage mixers are known from the most closely associated state of the art technology.

In DE 10 2006 024 778 B3, a mixer is described for which a wall structure for the flow guidance surfaces is provided, which essentially fills the profile of the housing, and thus causes a relatively high dynamic pressure loss. The wall structure is made of several layers of undulating strip material which is aligned parallel to the direction of flow. The individual layers respectively extend transverse to the direction of flow and are stacked on top of each other in an alignment which is transverse to the direction of flow. Here, the strip material in the individual layers is stacked on top of itself in such a manner that between the strip material of adjacent layers, a plurality of cells is formed which can respectively each be flowed through in the direction of flow.

Alongside the round undulation, it is also provided that the undulations of the strip material be designed with a rectangular or trapezoid form, as a result of which profiles for the individual cells can be achieved which are rectangular or hexagonal or with a honeycomb shape. The strip material forms a support onto which flow guidance surfaces are formed in pairs as mixing fins. For this purpose, the support comprises in alternation an area with a mixing fin and an area which is connected to it which has no mixing fins, so that one mixing fin extends into each cell.

In DE 20 2006 017 848 U1, a device for mixing exhaust gases is described with which a fin unit consisting of fins which are arranged directly following each other causes the exhaust gas to be mixed. The fin units are arranged transverse to the direction of flow adjacent to each other, and in the direction of flow one behind the other. The fins are connected to each other directly without a support, and are arranged in mirror symmetry in relation to a centre plane.

DE 10 2005 059 971 A1 describes a device for mixing a fluid with a large gas quantity flow which flows into a gas channel, in particular for the addition of a reduction agent into an exhaust gas which contains nitrogen oxide. For this purpose, a nozzle lance with a nozzle for the delivery of the fluid is used, the axis of which forms an angle with the direction of flow of the gas quantity flow. The nozzle is assigned a flat mixer element with an interspace, which forms an angle with the direction of flow of the gas quantity flow. On the mixer element, flow eddies are formed, and at least a part of the fluid enters these flow eddies. In order to prevent the formation of a coating, it is provided that when a liquid is used as a fluid, the nozzle lance is equipped with at least two atomiser nozzles which are inclined against the direction of flow of the gas quantity flow and towards each other in the opposite direction. The atomiser nozzles are assigned to a disc-type mixer element so that a separation of evaporated gaseous parts and non-evaporated droplet parts is possible.

DE 10 2006 043 225 A1 describes an exhaust gas plant for a combustion machine with an exhaust gas line which guides the exhaust gas and an injection device for injecting a liquid into the exhaust gas line. Downstream from the injection device, an evaporation unit is provided in the exhaust gas line which comprises at least one tubular plate body which extends in a longitudinal direction of the exhaust gas line, and results in an improved evaporation of the injected liquid. Furthermore, a spring-type clamp device is provided which affixes the evaporation device in the exhaust gas line, or which tensions it against said exhaust gas line.

As the most closely associated state of the art technology, an exhaust gas system is described in DE 10 2005 052 064 A1 with an injection device for a reduction agent, in which downstream from the injection device, a plate body is arranged which comprises at least one wall which extends in the longitudinal direction of the exhaust gas line, and which is exposed to the exhaust gas flow on both sides. The reduction agent is sprayed at least partially onto the wall, resulting in a conversion of the liquid reduction agent into a vaporous or gaseous state.

SUMMARY OF THE INVENTION

The idea of the invention is to provide a method with which the degree of mixing of the exhaust gas and the fluid is increased, depending on the shape of the exhaust gas pipe.

The solution is a method for mixing an exhaust gas flow with a fluid in an exhaust gas pipe of an exhaust gas system, in which the fluid is injected into the exhaust gas pipe by means of an injection device, characterized by the following method stages:

a) the exhaust gas flow is guided in the area of the injection device in a direction of flow parallel to the exhaust gas pipe in the exhaust gas pipe,
b) the fluid is injected in a central direction of injection which deviates from the direction of flow at an angle se, directly onto a deflection element which is arranged in the exhaust gas pipe,
c) by means of at least one sheet metal part which is provided on the deflection element and which is raised with reference to the direction of flow at least partially at an angle sv, the exhaust gas flow is partially diverted with reference to the direction of flow from its direction of flow into a central direction of distribution,
d) the fluid is carried along at least partially by the diverted part of the exhaust gas flow in the direction of distribution before and after impacting the deflection element, and is diverted by the raised sheet metal part into the direction of distribution. Here, it is essential that the exhaust gas flow is diverted by the sheet metal part before the mixer into the direction of distribution, which significantly deviates from the direction of flow. The angle se for the direction with which the fluid can be injected can here vary between 270° and 360°.

As a result, the fluid which is injected on one side is transported in the direction of the centre and over the entire profile of the exhaust gas pipe, and accordingly impacts the mixer over the entire profile of the mixer, and can then be mixed with the exhaust gas flow. Even when due to the installation space, the exhaust gas pipe is not straight but curved, it is advantageous when the direction of movement of the fluid can be influenced by the deflection element in relation to the progression of the exhaust gas pipe.

One further idea is that the fluid at least partially impacts a correction plate which is arranged with reference to the direction of injection before the sheet metal part, and at least partially undergoes a diversion into the direction of flow, and is then diverted into several mixing directions by a static mixer with at least one mixing element, and is thus mixed further. The correction plates are essentially arranged parallel to the sheet metal part above the sheet metal part, distributed on the side of the sheet metal part from which the fluid is injected. The distribution of the fluid before the mixer can be increased when further parts of the fluid flow are already diverted by the correction plate from the direction of injection into the direction of flow before they reach the sheet metal part.

Advantageous is that the raising of the sheet metal part is achieved by means of several fins which are provided on the sheet metal part, which are raised at the same or different angles sv, wherein the angle sv is between 0° and 85°. Due to the fact that the fins are raised, the sheet metal part can itself be arranged parallel to the direction of flow, so that only the fins ensure that the necessary diversion of the exhaust gas flow, and thus of the fluid, occurs.

Further advantageous is that the correction plate comprises several drill holes which run in a drill direction, wherein the drill direction runs with reference to the direction of flow at an angle bs of between 45° and 135°. As a result, a part of the fluid can be further distributed through one or more correction plates over the profile of the mixer. The fluid can thus partially flow further in the injection device and is partially diverted by the correction plates. The accumulated part of the flow is further diverted and carried along in the direction of flow, while the non-accumulated part of the flow which penetrates through the drill holes reaches the next correction plate in the direction of injection or the sheet metal part.

The correction plate is arranged parallel to the direction of flow and comprises several correction fins which are raised with reference to the direction of flow at an angle sk, wherein the angle sk is between 95° and 265°. The correction fins are stamped out of the correction plate, so that the fluid which is not accumulated can flow through the correction plate through the openings which are formed due to the stamping out. At the same time, the fluid is stabilised by the correction fins, so that in contrast to the flow conditions described above, it is diverted more slowly by the exhaust gas flow in the direction of flow.

Several mixing fins are provided on the mixing element which are raised with reference to the direction of flow at an angle ms and with reference to the direction of distribution at an angle mv, wherein the angle ms is a maximum of 70°, and the angle mv is greater than 1°. For the mixing process, it is advantageous that the fluid is further diverted by the mixing fins, and is not further guided in the same direction which is determined by the fin or the correction fin.

For this method a deflection element for arrangement in an exhaust gas pipe of an exhaust gas system is advantageous which guides an exhaust gas flow, and for retaining a fluid which is injected by means of an injection device into the exhaust gas system, wherein the deflection element can be positioned in the direction of flow before a static mixer with at least one mixing element and comprises at least one sheet metal part which can be positioned in the exhaust gas flow, wherein the sheet metal part is raised at least partially with reference to the direction of flow at an angle sv in a direction of distribution, as a result of which the exhaust gas flow is diverted with the fluid at least partially from the direction of flow into the direction of distribution. A fin which is raised at an angle sv is formed on the sheet metal part. The sheet metal part is arranged in the direction of flow directly before the mixer, in order to achieve a symmetrical distribution over the profile of the exhaust gas pipe and thus over the entire mixer profile of the fluid, which has in part already transformed into a gaseous state. The smaller the gaseous portion, the greater the effect of the deflection element on the mixing process by the mixer. The sheet metal part is at least partially raised by a fin in relation to the direction of flow at an angle sv in a direction of distribution, as a result of which the exhaust gas flow is diverted with the fluid at least partially from the direction of flow to the direction of distribution. The influence on the diversion of the sheet metal part itself, which is arranged parallel to the direction of flow, can be ignored.

On the sheet metal part, several fins are formed which are raised at the angle sv. With several fins, a diversion of the fluid which is distributed over the profile of the exhaust gas pipe is achieved. With several fins arranged one after the other in the direction of flow, the diversion of a flow element is greater, since the diversion in the direction of flow realised by the fins is partially accumulative.

The deflection element can be positioned in an exhaust gas pipe in such a manner that the fluid to a large extent impacts direction on the deflection element. As a result, the speed of the fluid is first reduced by the deflection element and the direction of flow can consequently be altered more easily.

Depending on the exhaust gas mass flow and the exhaust gas temperature, the penetration depth of the fluid in the exhaust gas pipe and the impact area of the fluid on the deflection element changes.

The deflection element comprises one or several correction panels which are arranged parallel to the direction of flow or parallel to the sheet metal part. The correction plates decelerate the fluid and enable an early diversion of the fluid by the exhaust gas flow. The correction plates can comprise differing lengths, or can be designed with equal lengths.

The correction plate comprises one or several correction fins which are raised at an angle sk between 95° and 265° and several openings which are formed transverse to the direction of flow by the correction fins, and/or several drill holes which run in a drill direction, wherein the drill direction runs at an angle bs between 45° and 135° with reference to the direction of flow. Alternatively, several drill holes are provided which run in a drill direction, wherein the drill direction runs at an angle bs between 45° and 135° in relation to the direction of flow. As a result, part of the fluid can flow directly in its direction of injection through an opening or a drill hole, and is not decelerated. A correction and stabilisation of the flow is achieved by the correction plates.

The sheet metal part protrudes with reference to the opposite direction of flow beyond all correction plates and the metal sheet part is arranged with reference to the central direction of injection behind the last correction plate. Due to the fact that the metal sheet part is thus arranged directly adjacent to the wall of the exhaust gas pipe which is opposite the injection point, the sheet metal part can influence the entire quantity of injected fluid.

The deflection element is designed in mirror symmetry with reference to a central plane which is oriented at right-angles to the direction of flow, or the fins and/or the correction fins are arranged in mirror symmetry with reference to the central plane. As a result of this symmetry, the central flow area in the exhaust gas pipe, in which the fluid is also injected, can be influenced to a significantly greater extent, since the central mixing elements or flow elements have the same alignment.

Advantageous is a multi-stage distributor consisting of a deflection element according to the description above and a static mixer which is affixed to the deflection element or which is arranged indirectly behind the deflection element with at least one mixing element, wherein the mixing element comprises at least one support for mixing fins or one flow element. Due to the combination of the deflection element with the mixer, a highly effective method for mixing is possible.

The metal sheet part or the correction plate is arranged on the support or on the flow element parallel or diagonal to the direction of flow. As a result, the mixer and the deflection element are designed at least partially, or also entirely, as a single piece, and are of identical material.

The mixing fins or the flow elements are raised with reference to the direction of flow at an angle ms of up to 70°, and with reference to the direction of distribution at an angle mv greater than 1°.

The mixing element is designed in mirror symmetry with reference to the central plane which is arranged at right-angles to the direction of flow, or the mixing fins and/or the supports are arranged in mirror symmetry with reference to the central plane.

Depending on the application, it could be advantageous that the mixing element is designed in point symmetry with reference to the direction of flow, or the mixing fins and/or the supports are arranged in point symmetry with reference to the direction of flow. Due to this arrangement, counter-rotating swirls are generated after the mixer in the exhaust gas pipe.

For assembly or retrofitting, it could be advantageous that in addition, a housing is provided which is parallel to the exhaust gas pipe and parallel to the direction of flow of the exhaust gas, on which the support or the flow elements are arranged, and the housing can be positioned on or in the exhaust gas pipe. As a result, the mixing elements or flow elements of the mixer can be pre-assembled in the housing before they are inserted into the exhaust gas pipe.

Advantageously the static mixer comprises several mixing elements for the exhaust gas which are arranged transverse to the direction of flow adjacent to each other, wherein each mixing element comprises several mixing fins and each mixing fin comprises one rear border area and two side border areas with reference to the direction of flow. Every mixing element comprises a support which is aligned parallel to the direction of flow, on which the mixing fins are arranged via their rear border area and are raised relative to the support. Every support comprises two end areas via which the respective support is affixed to the exhaust gas pipe. At least three mixing elements are provided, the supports of which are arranged adjacent to each other respectively in the area between the end areas transverse to the direction of flow, with a distance of at least 5 mm from each other. All mixing fins are arranged at a distance from the exhaust pipe with all side border areas and with the front border area. Preferably, the adjacent supports have a distance of between 5 mm and 100 mm, preferably between 12 mm and 15.5 mm. As a result, the mixing elements can be welded via the support on the exhaust gas pipe or on a separate housing, and the stability of the mixing element is retained by means of the supports and the mixing fins which are arranged on them, even during an increased exhaust gas flow and heat input. Due to the insulated mounting of each mixing element and due to the mixing fins which are arranged on the respective support at a distance from each other and facing the pipe wall, an improved circulation of the fins, and thus improved mixing, are achieved.

A static mixer or a distributor could also be advantageous, if the static mixer comprises several mixing elements which are arranged transverse to the direction of flow adjacent to each other, and the respective mixing element comprises a support which is aligned parallel to the direction of flow and several mixing fins which are arranged on the support and which are raised relative to the support. Each support comprises two end areas and two connecting areas which are arranged between the two end areas and which are arranged facing each other in the direction of the support and at a distance from the end areas. The end area and the first connecting area of the respective support are connected with each other, so that a partial area of the support forms a closed cell, and on the partial area of the support which surrounds the cell, at least two mixing fins are arranged on the support. As a result, the respective cell is not closed by a partial area of a support on which no mixing fin is provided, and is positioned in front of the mixing fin which extends into the cell.

For a static mixer or a distributor could also be advantageous, that the mixer comprises several flow elements for the exhaust gas which are arranged transverse to the direction of flow adjacent to each other. The respective flow element is formed from a sheet metal plate with an undulating cross-section profile which comprises several channels which run in the direction of parallel profile axes adjacent to each other. The profile axis of the respective flow element is oriented with reference to the direction of flow at an angle ms of up to 70° or at an angle ms of up to −70°. The profile axes are aligned by at least two flow elements which are arranged adjacent to each other in an angle ms which is equal in terms of direction and size. As a result, a flow of fluid which reaches the centre of the mixer, which flows in a direction transverse to the direction of flow, is essentially captured by the two central flow elements which have the same alignment, and can be diverted in another direction. The cross-section profile is preferably regularly undulating, and the profile axes all arranged in parallel.

Further advantages and details of the invention are explained in the patent claims and in the description, and shown in the figures.

BRIEF DESCRIPTION OF THE DRAWINGS

FIG. 6 shows a mixer according to FIG. 4 in an exhaust gas pipe FIG. 7 shows a point symmetric mixer with supports which are at a distance FIG. 8 shows a side view of a support with mixing fins which are raised in alternation FIG. 9 shows a side view of a mixer according to FIG. 7 with a deflection element with correction fins FIG. 9*a* shows a side view of a mixer according to FIG. 7 with a deflection element with drill holes FIG. 10 shows a view of a mixer with flow elements which lie in contact with each other FIG. 11 shows three flow elements for a mixer according to FIG. 10 which are arranged differently in relation to their respective profile axis FIG. 12 shows a side view of a mixer according to FIG. 10 in an exhaust pipe with a pre-activated deflection element FIG. 13 shows an angle diagram for the deflection element and the injection device FIG. 14 shows an angle diagram for the mixing fin in relation to the deflection element

DETAILED DESCRIPTION OF THE PREFERRED EMBODIMENT

Figure 1:
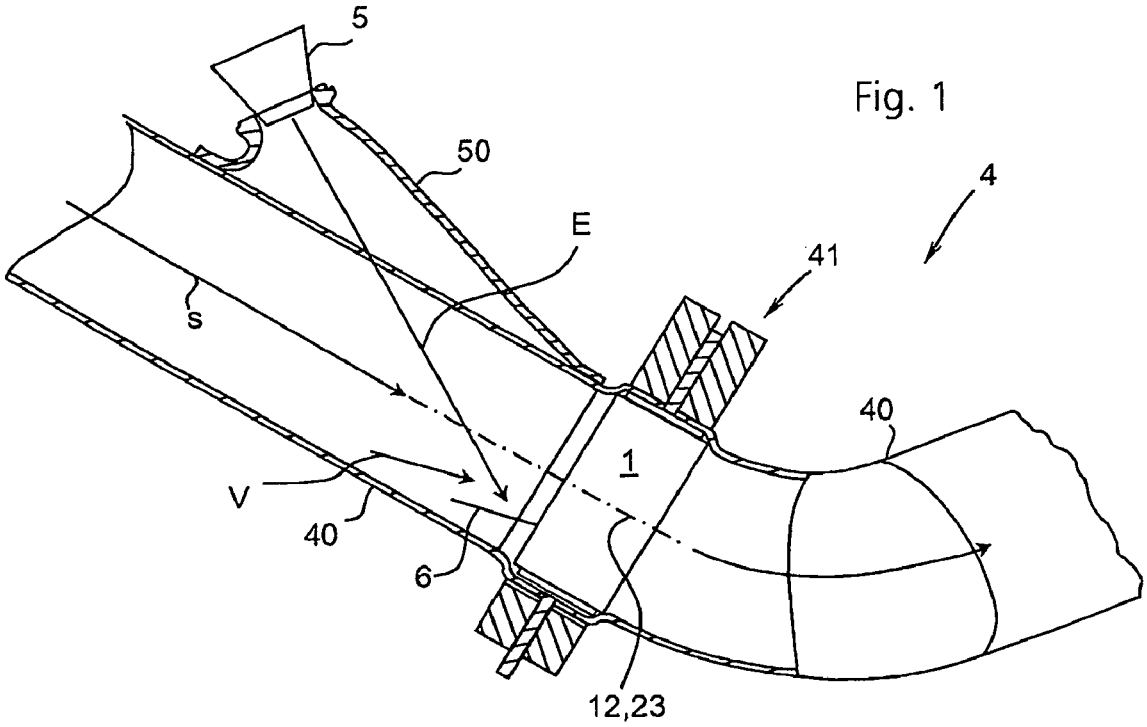
FIG. 1 shows a view of a part of an exhaust gas system with a exhaust gas pipe and an injection device, in which a mixer is arranged with a deflection element which is raised in relation to the direction of flow
Figure 3:
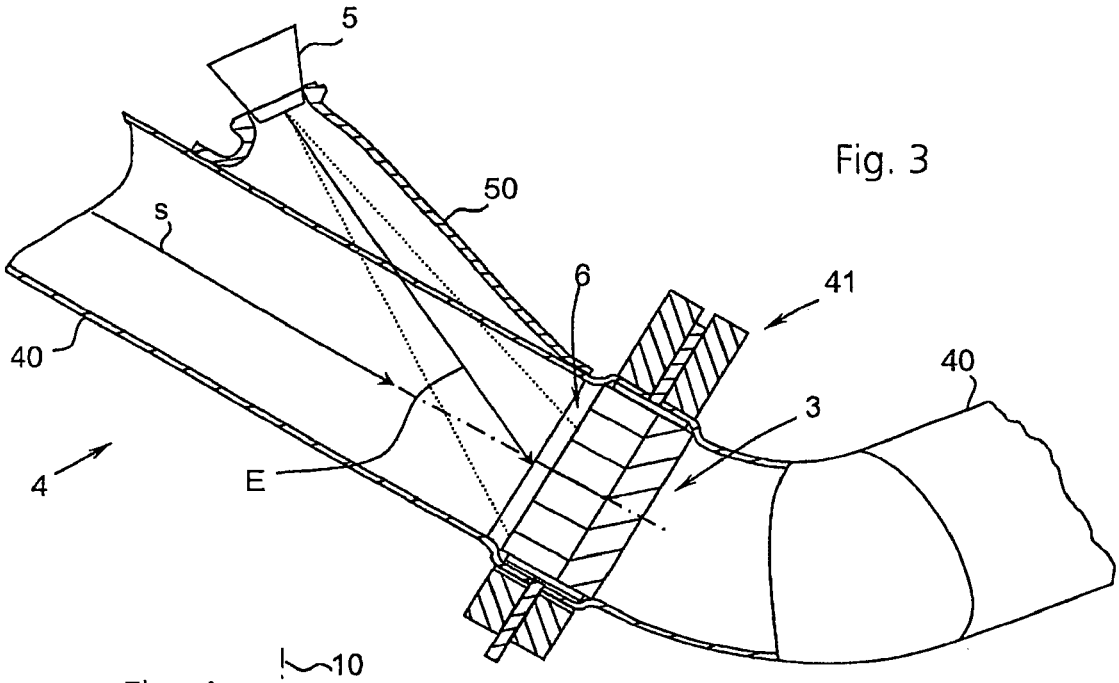
FIG. 3 shows a view according to FIG. 1 with a mixer and a deflection element which is designed in a similar manner to a mixer

FIG. 1 shows an exhaust pipe 40 as part of an exhaust gas system 4, into which a fluid is injected in a direction of injection E as a reduction agent via a flange 50 which is arranged on the exhaust gas pipe 40 and an injection device 5 which is positioned on the flange 50. For reasons of clarity, the figures show the central direction of injection E and not the real, conical flow conditions which are indicated in FIG. 3 by the two dotted lines which form a v shape.

In the exhaust gas pipe 40, an exhaust gas essentially flows in parallel to the exhaust gas pipe 40 in a direction of flow S. For the description of the invention, it is assumed for purposes of simplicity that the direction of flow S runs parallel before a deflection element 6 over the entire pipe cross-section of the exhaust gas pipe 40.

Depending on the mass flow of the reduction agent, the reduction agent flows in the direction of injection E and into the exhaust gas pipe 40, to a greater or lesser extent diverted by the exhaust gas flow. After the injection device 5, a distributor, consisting of a mixer 1 with a deflection element 6, is provided in the direction of flow S. The distributor is positioned in the exhaust gas pipe 40 via the mixer 1 and a flange connection 41.

The reduction agent to a large extent impacts the deflection element 6, so that the flow impulse of the reduction agent is reduced. The deflection element 6 is raised at an angle sv relative to the direction of flow S, so that the exhaust gas flow is diverted via the deflection element 6 from the direction of flow S into a direction of distribution V. Due to this diverted exhaust gas flow, the reduction agent is swept along in the direction of distribution V partially before and above all after it impacts the deflection element 6, and is guided into the pipe centre of the exhaust gas pipe 40.

Figure 2:
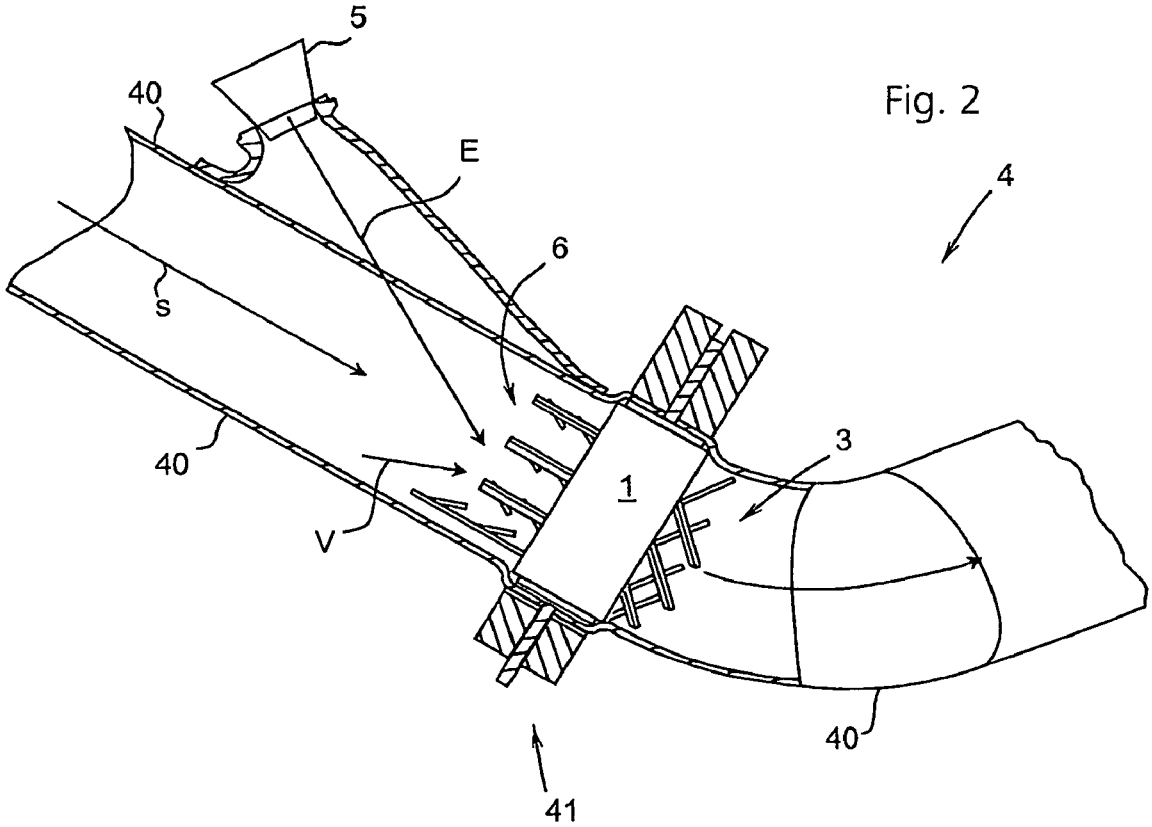
FIG. 2 shows a view according to FIG. 1 with a mixer and a deflection element with correction plates

FIG. 2 shows part of an exhaust gas system 4 as is described with reference to FIG. 1, although here, a mixer 1 with mixing fins 31 is integrated, as is generally shown in greater detail in FIGS. 4 to 7. The deflection element 6 for such mixers 1 with mixing fins 31 is shown in greater detail in FIG. 9, and comprises as part of the deflection element 6 a sheet metal part 60 which is arranged parallel to the direction of flow, with a fin 61 which is raised at the angle sv and further correction plates 62 with correction fins 64.

Figure 4:
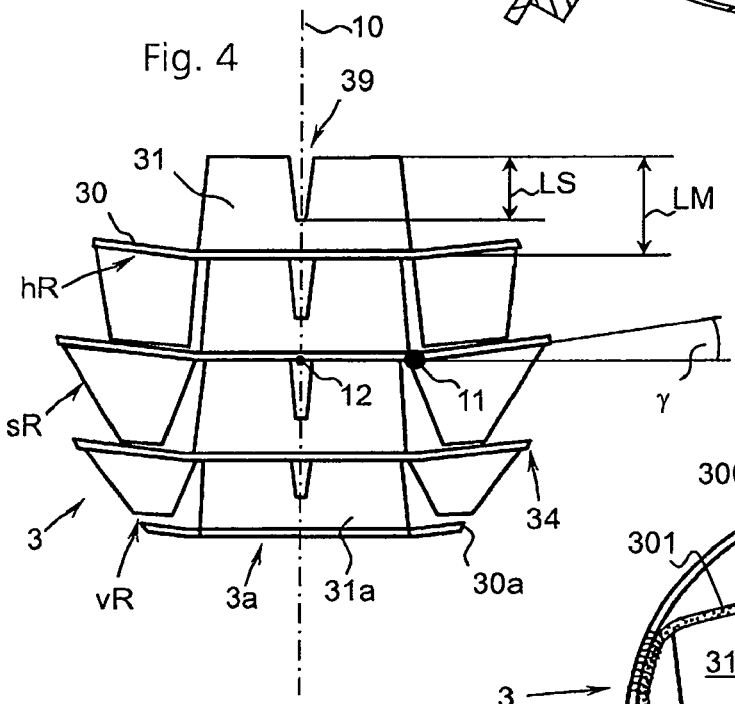
FIG. 4 shows a mirror symmetry mixer

The mixers 1 according to FIGS. 4, 6 and 7 comprise three mixing elements 3 which are arranged transverse to the direction of flow S and adjacent to each other respectively, and one to two additional mixing elements 3*a*. The mixing element 3, 3*a* consists fundamentally of a support 30, 30*a* and one or several mixing fins 31, 31*a* which are arranged on it. The respective mixing fin 31, 31*a* is affixed to the support 30, 30*a* via its border area hR with reference to the direction of flow S. Side border areas sR and a front border area vR with reference to the direction of flow S form free flow edges and are neither connected to another mixing fin 31, 31*a*, nor to a housing 2 or an exhaust pipe 40.

The support 30 comprises on both its ends one end area 34 respectively, in which no mixing fin 31 is provided, and which is angled in accordance with FIG. 7. The support 30 is affixed via the two end areas 34 as shown as an example in FIG. 7 on a housing 2 or according to FIG. 6 on an exhaust gas pipe 40. Between the two end areas 34, the support 30 hangs freely in the housing 2 or in the exhaust gas pipe 40, i.e. it is neither supported or held by another construction element, nor does it support or hold another construction element. Furthermore, the supports 30 are essentially arranged parallel to each other in the areas between the end areas 34, and are at a distance 35 of approx. 13.5 mm from each other.

The housing 2 is a cylindrical pipe part, on the inner sheath surface 20 of which the mixing elements 3 and, depending on the exemplary embodiment, the additional mixing elements 3*a*, are affixed. A mixer 1 of this type is inserted with the housing 2 into an exhaust gas pipe 40 of an exhaust gas system 4, as is shown in FIG. 2, and exhaust gas flows through it in a direction of flow S which is parallel to a central axis 23 of the housing 2.

The support 30 consists of a strip-shaped sheet metal material with a width 32 defined in FIG. 8, and is aligned parallel to the direction of flow S. The direction of flow S refers to the main direction of flow of the exhaust gas within the mixer 1, and runs parallel to a central axis 12 of the mixer 1 and the central axis 23 of the housing 2. Due to the fact that the support 30 runs parallel to the direction of flow S, and thus parallel to the wall of the exhaust gas pipe 40, the mixer 1 can simply be mounted transverse to the direction of flow in the exhaust gas pipe 40.

In the exemplary embodiments according to FIG. 7, with three mixing elements 3 which are essentially arranged in parallel adjacent to each other and in point symmetry, each of the mixing elements 3 is formed by a support 30 and four mixing fins 31. The entire mixing element 3 thus consists of a support 30 and four mixing fins 31.

The support 30 can be divided between the end areas 34 into three partial areas 36 to 38. Outer partial areas 37, 38 respectively adjoin a central partial area 36 on the opposite side. Each of the outer partial areas 37, 38 is at an angle in relation to the central partial area 36, i.e. the central partial area 36 encompasses an angle $\alpha$ with each of the two outer partial areas 37, 38. With reference to a first axis 11 which runs parallel to the direction of flow S, the two outer partial areas 37, 38 thus cut through the central partial area 36 at an angle $\alpha$ of approx. 12°. The outer partial areas 37, 38 are angled conversely with reference to the central partial area 36, so that the support 30 is designed in point symmetry with reference to a central axis 12 which is parallel to the direction of flow S, i.e. the support 30 and the mixing fins 31 are formed and arranged point symmetrically to each other.

As well as the three mixing elements 3, two additional mixing elements 3*a* are also provided in the areas next to the mixing elements 3. The additional mixing element 3*a* is formed by a support 30*a* and a mixing fin 31*a*. The additional mixing element 3*a* is affixed via its two end areas 34*a* to the inner sheath surface 20 of the housing 2, and in a freely supporting manner between the two end areas 34*a*.

With the exemplary embodiment according to FIG. 4, the support 30 can be divided in accordance with the exemplary embodiment according to FIG. 7 into three partial areas 36 to 38. Outer partial areas 37, 38 respectively adjoin a central partial area 36 on the opposite side. Each of the outer partial areas 37, 38 at an angle in relation to the central partial area 36, i.e. the central partial area 36 encompasses an angle $\alpha$ with each of the two outer partial areas 37, 38. With reference to a first axis 11 which runs parallel to the direction of flow S, the two outer partial areas 37, 38 thus cut through the central partial area 36 at an angle $\gamma$ of approx. 9°. The outer partial areas 37, 38 are angled in the same direction with reference to the central partial area 36, so that the support 30 is designed in mirror symmetry with reference to a central plane 10 which is parallel to the direction of flow S.

As a result of the point symmetry, the flow on one side of the central plane 10 is diverted upwards and outwards, converse to the flow on the other side of the central plane 10 in a direction transverse to the direction of flow S. The flow is represented by arrows in FIG. 7.

In the exemplary embodiments according to FIGS. 4 to 9*a*, the mixing fins 31 encompass an angle $\beta$ with reference to the direction of the support 30 and an angle ms with reference to the direction of flow S. The mixing fins 31 are shown in alternation. As is shown in greater detail in FIGS. 8 and 9, the angle β is +135° or −135°, and the angle ms is +45° or −45°. Furthermore, mixing fins 31 which are directly adjacent partially comprise, as is shown in particular in FIG. 7, a regular distance 33 from each other of at least 1 mm.

In an exemplary embodiment not shown, the adjacent end areas 34 are connected with each other by two supports 30 which are arranged adjacent to each other. Additionally, one end area 34*a* respectively of the additional mixing elements 3*a* is connected with one end area 34 respectively of the adjacent mixing element 3. This is achieved by means of the fact that the three mixing elements 3 and the two additional mixing elements 3*a* are produced from a single sheet metal strip.

On an outer side 21 of the housing 2, a securing element 24 is provided, as shown in FIGS. 7 and 9. The securing element 24 is designed as a burl and protrudes opposite the outer side 21. Due to the securing element 24, the mixer 1 can be fastened against being turned around the central axis 23 in the exhaust gas pipe 40. Furthermore, the securing element 24 also serves the purpose when being fastened of simultaneously specifying the rotating position of the mixer 1 with reference to the central axis 23 in the exhaust gas system 4. For this purpose, a corresponding retainer which is not shown in greater detail is provided at a certain position, into which the securing element 24 is pushed in the direction of the central axis 23.

In accordance with FIG. 9, the mixer 1 is mounted with the housing 2 between two exhaust gas pipes 40, 40'. For this purpose, the two exhaust gas pipes 40, 40' are attached on both sides to the housing 2. In order to weld the two exhaust gas pipes 40, 40' and for the weld connection of the exhaust gas pipes 40, 40' with the mixer 1, a gap 42 is provided between the exhaust gas pipes 40, 40'. The gap 42 is created as a result of the fact that the exhaust gas pipes 40, 40' are distanced from each other in the direction of the central axis 12 by the circumference of distributed adjusting elements 22, onto which the respective exhaust gas pipe 40, 40' adjoins on one side respectively in the direction of the central axis 12.

The mixer 1 according to FIGS. 4 and 6 is designed in mirror symmetry to a central plane 10 which is oriented parallel to the direction of flow S, i.e. the support 30 and the mixing fins 31 are formed and arranged in mirror symmetry to each other. These mixers 1 comprise three mixing elements 3 which are arranged in parallel and adjacent to each other, wherein each of the mixing elements 3 is formed by a support 30 and one or three mixing fins 31 arranged on the support 30.

The support 30 can be divided between the end areas 34 into three partial areas 36 to 38. Outer partial areas 37, 38 respectively adjoin a central partial area 36 on the opposite side. Each of the outer partial areas 37, 38 at an angle in relation to the central partial area 36, i.e. the central partial area 36 encompasses an angle γ with each of the two outer partial areas 37, 38. With reference to a first axis 11 which runs parallel to the direction of flow S, the two outer partial areas 37, 38 thus cut through the central partial area 36 at an angle γ of approx. 9°. The outer partial areas 37, 38 are angled in the same direction with reference to the central partial area 36, so that the support 30 is designed in mirror symmetry with reference to a central axis 12 which is parallel to the direction of flow S.

The central mixing fin 31 comprises a slit 39 in its centre, the length LS of which is between 50% and 80% of a length LM of the mixing fin 31. Due to the slit 39, the formation of swirls is reduced, since the flow in the central area is diverted to a lesser extent. Furthermore, precisely in the central area of the mixer 1, in which the mass flow is greatest, the flow dynamic resistance of the mixer 1 is reduced.

As well as the three mixing elements 3, an additional mixing element 3*a* is provided below the three mixing elements 3. The additional mixing element 3*a* is formed by a support 30*a* and a mixing fin 31*a*, which also comprises a slit 39. The additional mixing element 3*a* is affixed via its two end areas 34*a* to the inner sheath surface 20 of the housing 2 and in a freely supporting manner between the two end areas 34*a*.

Figure 5:
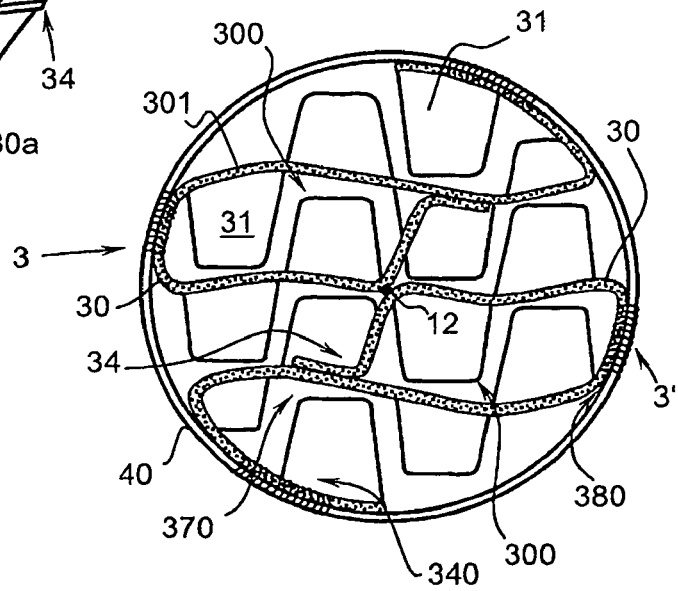
FIG. 5 shows a point symmetric mixer with a mixing element with a cell

FIG. 5 shows a point symmetrical mixer 1 with two identical mixing elements 3, 3'. The respective mixing element 3, 31 respectively comprises two end areas 34, 340 and two connecting areas 370, 380 which are provided between the end areas 34, 340. The end area 34 and the first connecting area 370 of the respective support 30 are connected with each other, so that a partial area 301 of the support 30 forms a closed cell 300. On the partial area 301 of the support 30 which surrounds the cell 300, two mixing fins 31 are arranged on the support 30. The mixing element 3 is affixed to the exhaust gas pipe 40 via the end area 340 and the second connecting area 380.

The point symmetrical mixer 1 according to the exemplary embodiments in accordance with FIGS. 5 and 7 can equally be combined with a deflection element 6, as can the mirror symmetrical mixer 1 according to the exemplary embodiments in accordance with FIGS. 4 and 6. The deflection element 6 comprises, as is shown in FIGS. 9 and 9*a*, a sheet metal part 60 with one or several fins 61 which are raised at an angle sv of approx. 20°. Due to the fins 61, the exhaust gas flow is diverted upwards in a direction of distribution V and is thus the reduction agent is also swept upwards. The sheet metal part 60 is directly arranged on the support 30, 30*a* and in accordance with the exemplary embodiments shown forms with the mixing element 3, 3*a* a construction element which is a single piece and which is made of identical material.

The deflection element 6 comprises several correction plates 62, 62', 62" which are arranged parallel to the direction of flow S and parallel to the sheet metal part 60, which cause the reduction agent to be distributed directly before the mixer 1. The correction plate 62 is arranged directly on the support 30, 30*a* and in accordance with the exemplary embodiments shown forms with the mixing element 3, 3*a* a construction element which is a single piece and which is made of identical material.

The correction plates 62, 62', 62" comprise according to FIG. 9 several correction fins 64 which are raised with reference to the direction of flow S at an angle sk of 155°. The correction fins 64 are, as shown in detail in FIG. 14, partially stamped out of the correction plate 62 and protrude from the correction plate 62 in the direction of the adjacent correction plate 62 and/or in the direction of the sheet metal part 60. As a result, below the correction fin 64, an opening 63 is formed on the respective correction plate 62 which corresponds to the area of the correction fin 64 which protrudes from the correction plate 62. The correction fin 64 can protrude on one or both sides of the correction plate 62.

Equally, the fin 61 on the sheet metal part 60 is stamped out, so that the sheet metal part 60 comprises an opening 63 below the respective fin 61 which corresponds to the area of the fin 61 which protrudes from the sheet metal part 60. As is shown in FIG. 14, the correction fin 64 protrudes from the correction plate 62 on both sides and the fin 61 protrudes on one side from the sheet metal part 60.

The correction plates 62, 62', 62" according to FIG. 9*a* comprise several drill holes 65 instead of correction fins, which are oriented in a drill direction B which runs at an angle bs of 90° to the direction of flow S, through which the exhaust gas flow with the reduction agent can flow at least partially through the deflection element 6 in the direction of the central axis 12.

FIG. 3 also shows a part of an exhaust gas system 4 as described in FIGS. 1 and 2, however in this exemplary embodiment, a mixer 1 is combined with a deflection element 6 which is constructed in a similar manner to the mixer 1 itself. A mixer 1 of this type is formed in accordance with FIG. 10 from several flow elements 7, 7' which abut adjacent to each other.

FIG. 11 shows in detail that the mixer 1 is constructed of several flow elements 7, 7', 7" which abut adjacent to each other. The respective flow element 7, 7', 7" is formed of a sheet metal plate 70 with an undulating cross-section profile 71, which comprises a front side 73 and several channels 72 which run adjacent to each other in the direction of parallel profile axes 74. The profile axes 74, 74' of the two adjacent flow elements 7, 7' run alternately raised with reference to the direction of flow S at an angle ps of +40° and −40°. As a result, the flow is simultaneously diverted upwards and downwards in the channels formed by the two flow elements 7, 7'.

However, according to the invention, the profile axes 74', 74" of the two central flow elements 7', 7" which are adjacent with reference to the central plane 10 run parallel, i.e. at an angle ps of −40° which is the same in terms of its direction and size, and thus do not abut each other. As a result, as is clarified by the arrows in FIG. 10, the flow within the channels which are formed by the two flow elements 7', 7" is diverted only upwards, i.e. in the same direction. The angle ps corresponds to the angle ms in the exemplary embodiments described above.

Due to the same alignment of the profile axes 74', 74" of the two flow elements 7', 7" which are arranged opposite with reference to the central plane 10 and at the same time, adjacent to each other, a mirror symmetrical geometry of the mixer 1 is achieved with reference to the central plane 10. The part of the exhaust gas flow and reduction agent which flows in the centre of the mixer 1 is thus diverted in one direction within these two flow elements 7', 7".

FIG. 12 shows a cross-section of a mixer 1 in which the profile axes 74, 74' are raised at an angle of ±30°. Before the mixer 1, a deflection element 6 is arranged which is constructed in a similar manner to the mixer 1. With the deflection element 6, several sheet metal parts 60 with a cross-section profile 66 are also arranged directly adjacent to each other. Profile axes 67, 67' of the deflection element 6 of adjacent sheet metal parts 60 are not raised with reference to the direction of flow S, i.e. they run parallel to the direction of flow S. The deflection element 6 thus forms individual channels between the individual sheet metal parts 60 in correspondence with the two central flow elements 7', 7" of the mixer 1, in which the exhaust gas flow and the reduction agent are guided in only a direction which is parallel to the direction of flow S.

FIG. 13 shows an angle diagram which represents the angles and angle ratios described above for the correction fin 64 and the direction of injection E, together with the direction of distribution V and the direction of flow S. FIG. 14 shows such an overview with reference to the mixing fins 31 and the sheet metal plates 70, and to the direction of distribution V and the direction of flow S.

The invention claimed is:

1. A deflection element for arrangement in an exhaust gas pipe of an exhaust gas system which guides an exhaust gas flow, and for retaining a fluid which is injected by means of an injection device into the exhaust gas system, wherein the deflection element can be positioned in a direction of flow (S) before a static mixer with at least one mixing element and comprises at least one sheet metal part which can be positioned in the exhaust gas flow, wherein the sheet metal part is raised at least partially with reference to the direction of flow (S) at an angle sv in a direction of distribution (V), as a result of which the exhaust gas flow is diverted with the fluid at least partially from the direction of flow (S) into the direction of distribution (V), wherein a fin which is raised at an angle sv is formed on the sheet metal part, wherein the deflection element comprises one or several correction plates which are arranged parallel to the direction of flow (S) or parallel to the sheet metal part, and wherein the sheet metal part protrudes with reference to the opposite direction of flow (S) beyond all correction plates and the metal sheet part is arranged with reference to a central direction of injection (E) behind the last correction plate.

2. The deflection element according to claim 1, wherein the deflection element can be positioned in an exhaust gas pipe in such a manner that the fluid to a large extent impacts direction on the deflection element.

3. The deflection element according to claim 1, wherein the correction plate comprises a) one or several correction fins which are raised at an angle sk between 95° and 265° and several openings which are formed transverse to the direction of flow (S) by the correction fins, or b) several drill holes which run in a drill direction (B), wherein the drill direction (B) runs at an angle bs between 45° and 135° With reference to the direction of flow (S), or c) both a) and b).

4. The deflection element according to claim 1, wherein the deflection element is designed in mirror symmetry with reference to a central plane which is oriented at right-angles to the direction of flow (S), or the fins or the correction fins, or both the fins and correction fins are arranged in mirror symmetry with reference to the central plane.

5. The deflection element according to claim 1, wherein on the sheet metal part, several fins are formed which are raised at the angle sv.

6. A multi-stage distributor consisting of a deflection element according to claim 5 and a static mixer which is affixed to the deflection element or which is arranged indirectly behind the deflection element with at least one mixing element, wherein the mixing element comprises at least one support for mixing fins or one flow element.

7. The distributor according to claim 6, wherein the metal sheet part or a correction plate is arranged on the support or on the flow element parallel or diagonal to the direction of flow (S).

8. The distributor according to claim 7, wherein the mixing fins or the flow elements are raised with reference to the direction of flow (S) at an angle ms of up to 70°, and with reference to the direction of distribution (V) at an angle my greater than 1°.

9. The distributor according to claim 6, wherein the mixing element is designed in mirror symmetry with reference to the central plane which is arranged at right-angles to the direction of flow (S), or the mixing fins or the supports, or both the mixing fins and the supports are arranged in mirror symmetry with reference to the central plane.

10. The distributor according to claim 6, wherein the mixing element is designed in point symmetry with reference to the direction of flow (S), or the mixing fins or the supports, or both the mixing fins and supports are arranged in point symmetry with reference to the direction of flow (S).

11. The distributor according to claim 6, wherein in addition, a housing is provided which is parallel to the exhaust gas pipe and parallel to the direction of flow (S) of the exhaust gas, on which the support or the flow elements are arranged, and the housing can be positioned on or in the exhaust gas pipe.

12. The distributor according to claim 6, wherein a) the static mixer comprises several mixing elements for the exhaust gas which are arranged transverse to the direction of flow (S) adjacent to each other, wherein each mixing element comprises several mixing fins and each mixing fin (31) comprises one rear border area (hR) and two side border areas (sR) with reference to the direction of flow (S), b) every mixing element comprises a support which is aligned parallel to the direction of flow (S), on which the mixing fins are arranged via their rear border area (hR) and are raised relative to the support, d) every support comprises two end areas via which the respective support is affixed to the exhaust gas pipe, e) at least three mixing elements are provided, the supports of which are arranged adjacent to each other respectively in the area between the end areas transverse to the direction of flow (S), with a distance of at least 5 mm from each other, f) all mixing fins are arranged at a distance from the exhaust pipe with all side border areas (sR) and with the front border area (vR).

13. The distributor according to claim 6, wherein the static mixer comprises several mixing elements which are arranged transverse to the direction of flow (S) adjacent to each other, and a) the respective mixing element comprises a support which is aligned parallel to the direction of flow (S) and several mixing fins which are arranged on the support and which are raised relative to the support, b) each support comprises two end areas and two connecting areas which are arranged between the two end areas and which are arranged facing each other in the direction of the support and at a distance from the end areas, c) the end area and the first connecting area of the respective support are connected with each other, so that a partial area of the support forms a closed cell, and d) on the partial area of the support which surrounds the cell, at least two mixing fins are arranged on the support.

14. The distributor according to claim 6, wherein the mixer comprises several flow elements, for the exhaust gas which are arranged transverse to the direction of flow (S) adjacent to each other, and e) the respective flow element is formed from a sheet metal plate with an undulating cross-section profile which comprises several channels which run in the direction of parallel profile axes adjacent to each other, f) the profile axis of the respective flow element is oriented with reference to the direction of flow (S) at an angle ms of up to 70° or at an angle ms of up to −70° and wherein g) the profile axes are aligned by at least two flow elements which are arranged adjacent to each other in an angle ms which is equal in terms of direction and size.

15. A multi-stage distributor comprising: a deflection element for arrangement in an exhaust gas pipe of an exhaust gas system which guides an exhaust gas flow, and for retaining a fluid which is injected by means of an injection device into the exhaust gas system, wherein the deflection element can be positioned in a direction of flow (S) before a static mixer with at least one mixing element and comprises at least one sheet metal part which can be positioned in the exhaust gas flow, wherein the sheet metal part is raised at least partially with reference to the direction of flow (S) at an angle sv in a direction of distribution (V), as a result of which the exhaust gas flow is diverted with the fluid at least partially from the direction of flow (S) into the direction of distribution (V), wherein a fin which is raised at an angle sv is formed on the sheet metal part, wherein on the sheet metal part, several fins are formed which are raised at the angle sv, wherein the static mixer is affixed to the deflection element or is arranged indirectly behind the deflection element with at least one mixing element, wherein the mixing element comprises at least one support for mixing fins or one flow element, wherein the static mixer comprises several mixing elements which are arranged transverse to the direction of flow (S) adjacent to each other, and a) the respective mixing element comprises a support which is aligned parallel to the direction of flow (S) and several mixing fins which are arranged on the support and which are raised relative to the support, b) each support comprises two end areas and two connecting areas which are arranged between the two end areas and which are arranged facing each other in the direction of the support and at a distance from the end areas, c) the end area and the first connecting area of the respective support are connected with each other, so that a partial area of the support forms a closed cell, and d) on the partial area of the support which surrounds the cell, at least two mixing fins are arranged on the support.

16. The distributor according to claim 15, wherein the deflection element can be positioned in an exhaust gas pipe in such a manner that the fluid to a large extent impacts direction on the deflection element.

17. The distributor according to claim 15, wherein the deflection element comprises one or several correction plates which are arranged parallel to the direction of flow (S) or parallel to the sheet metal part.

18. The distributor according to claim 17, wherein the correction plate comprises a) one or several correction fins which are raised at an angle sk between 95° and 265° and several openings which are formed transverse to the direction of flow (S) by the correction fins, or b) several drill holes which run in a drill direction (B), wherein the drill direction (B) runs at an angle bs between 45° and 135° with reference to the direction of flow (S), or c) both a) and b).

19. The distributor according to claim 17, wherein the sheet metal part protrudes with reference to the opposite direction of flow (S) beyond all correction plates and the metal sheet part is arranged with reference to the central direction of injection (E) behind the last correction plate.

20. The distributor according to claim 17, wherein the deflection element is designed in mirror symmetry with reference to a central plane which is oriented at right-angles to the direction of flow (S), or the fins or the correction fins, or both the fins and correction fins are arranged in mirror symmetry with reference to the central plane.

21. The distributor according to claim 15, wherein the metal sheet part or a correction plate is arranged on the support or on the flow element parallel or diagonal to the direction of flow (S).

22. The distributor according to claim 21, wherein the mixing fins or the flow elements are raised with reference to the direction of flow (S) at an angle ms of up to 70°, and with reference to the direction of distribution (V) at an angle my greater than 1°.

23. The distributor according to claim 15, wherein the mixing element is designed in mirror symmetry with reference to the central plane which is arranged at right-angles to the direction of flow (S), or the mixing fins or the supports, or both the mixing fins and the supports are arranged in mirror symmetry with reference to the central plane.

24. The distributor according to claim 15, wherein the mixing element is designed in point symmetry with reference to the direction of flow (S), or the mixing fins or the supports, or both the mixing fins and supports are arranged in point symmetry with reference to the direction of flow (S).

25. The distributor according to claim 15, wherein in addition, a housing is provided which is parallel to the exhaust gas pipe and parallel to the direction of flow (S) of the exhaust gas, on which the support or the flow elements are arranged, and the housing can be positioned on or in the exhaust gas pipe.

26. The distribution according to claim 15, wherein a) the static mixer comprises several mixing elements for the exhaust gas which are arranged transverse to the direction of flow (S) adjacent to each other, wherein each mixing element comprises several mixing fins and each mixing fin (31) comprises one rear border area (hR) and two side border areas (sR) with reference to the direction of flow (S), b) every mixing element comprises a support which is aligned parallel to the direction of flow (S), on which the mixing fins are arranged via their rear border area (hR) and are raised relative to the support, d) every support comprises two end areas via which the respective support is affixed to the exhaust gas pipe, e) at least three mixing elements are provided, the supports of which are arranged adjacent to each other respectively in the area between the end areas transverse to the direction of flow (S), with a distance of at least 5 mm from each other, f) all mixing fins are arranged at a distance from the exhaust pipe with all side border areas (sR) and with the front border area (vR).

27. The distribution according to claim 15, wherein the mixer comprises several flow elements, for the exhaust gas which are arranged transverse to the direction of flow (S) adjacent to each other, and e) the respective flow element is formed from a sheet metal plate with an undulating cross-section profile which comprises several channels which run in the direction of parallel profile axes adjacent to each other, f) the profile axis of the respective flow element is oriented with reference to the direction of flow (S) at an angle ms of up to 70° or at an angle ms of up to −70° and wherein g) the profile axes are aligned by at least two flow elements which are arranged adjacent to each other in an angle ms which is equal in terms of direction and size.

* * * * *

UNITED STATES PATENT AND TRADEMARK OFFICE

CERTIFICATE OF CORRECTION

PATENT NO. : 8,272,777 B2
APPLICATION NO. : 12/386627
DATED : September 25, 2012
INVENTOR(S) : Kohrs et al.

It is certified that error appears in the above-identified patent and that said Letters Patent is hereby corrected as shown below:

In the Claims:

Claim 8, column 12, line 55: the phrase "...angle my..." should be -- "...angle mv..." --

Claim 22, column 14, line 66: the phrase "...angle my..." should be -- "...angle mv..." --

Signed and Sealed this
Sixteenth Day of April, 2013

Teresa Stanek Rea
*Acting Director of the United States Patent and Trademark Office*